United States Patent [19]

Leblanc

[11] Patent Number: 5,067,327

[45] Date of Patent: Nov. 26, 1991

[54] REFRIGERANT RECOVERY AND RECHARGING DEVICE

[75] Inventor: Charles B. Leblanc, Cocagne, Canada

[73] Assignee: Enspeco Inc., Cocagne, Canada

[21] Appl. No.: 584,073

[22] Filed: Sep. 18, 1990

[51] Int. Cl.[5] ..... F25B 45/00

[52] U.S. Cl. ..... 62/292; 62/149; 62/529; 141/82

[58] Field of Search ..... 62/77, 85, 142, 292, 62/475, 529; 141/82

[56] References Cited

U.S. PATENT DOCUMENTS

| | | | |
|---|---|---|---|
| 709,814 | 9/1902 | Coleman | 62/509 |
| 1,533,336 | 4/1925 | Pownall | 62/326 |
| 2,139,297 | 3/1937 | Bergdoll | 62/348 |
| 4,261,178 | 4/1981 | Cain | 62/149 |
| 4,364,236 | 12/1982 | Lower et al. | 62/77 |
| 4,768,347 | 9/1988 | Manz et al. | 62/149 |
| 4,805,416 | 2/1989 | Manz et al. | 62/292 |
| 4,887,435 | 12/1989 | Anderson, Jr. | 62/85 |
| 4,903,499 | 2/1990 | Merritt | 62/292 |

*Primary Examiner*—Albert J. Makay
*Assistant Examiner*—John Sollecito
*Attorney, Agent, or Firm*—Smart & Biggar

[57] ABSTRACT

In a device to recover refrigerant from a refrigeration circuit and subsequently recharge the refrigeration circuit with the recovered refrigerant, the condenser and refrigerant storage means of the device is a cooled tank. Refrigerant vapor inputs the base of the tank through a one-way check valve so that the entering vapor is cooled as it bubbles through any liquid refrigerant in the tank and then condenses on the cool walls of the tank.

10 Claims, 1 Drawing Sheet

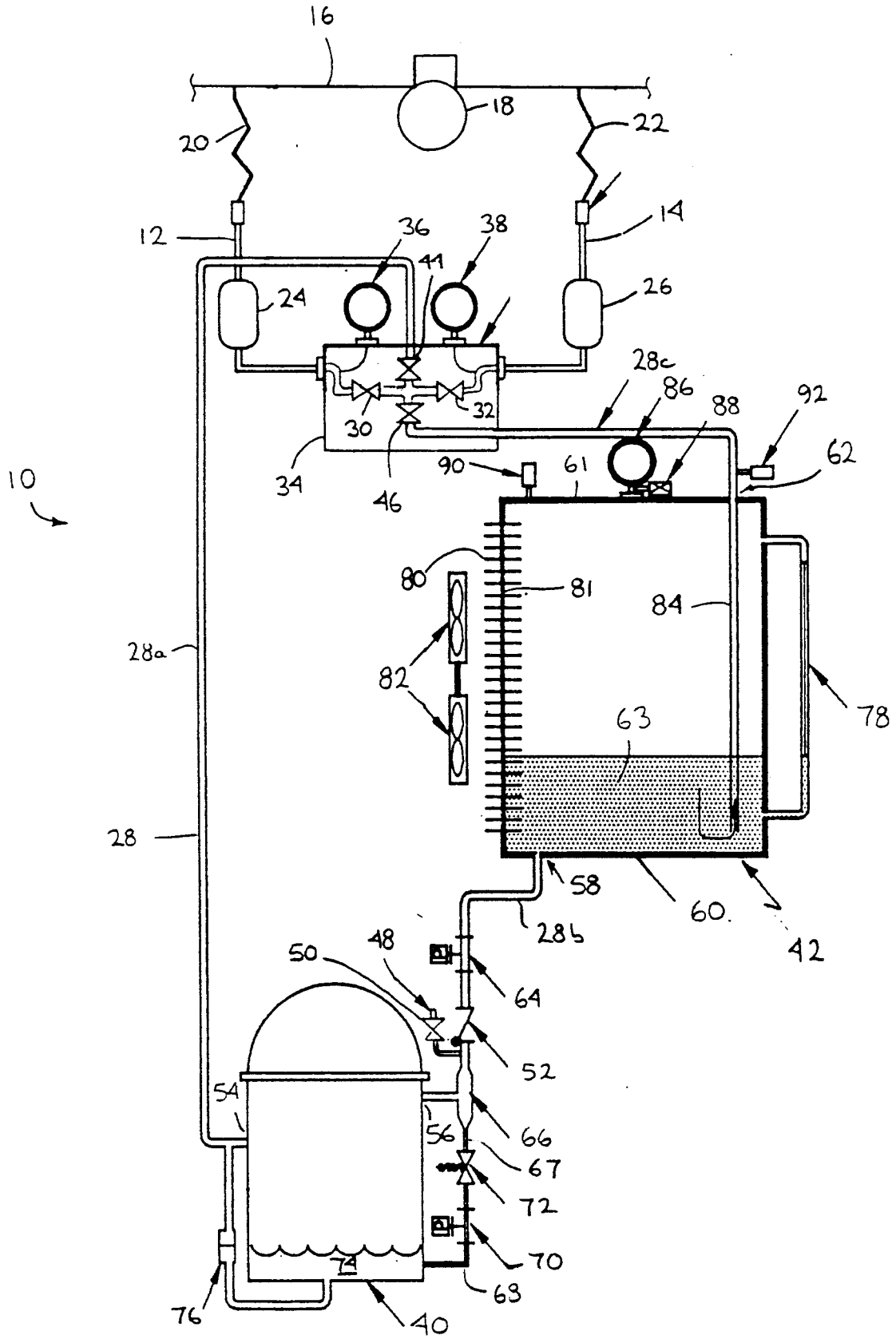
16
18
20
22
12
14
36
38
41
24
26
28c
86
88
92
62
30
32
34
46
90
61
10
80
81
84
28a
82
78
63
28
58
60
42
28b
50
48
64
52
54
56
66
67
72
70
74
68
76
40

REFRIGERANT RECOVERY AND RECHARGING DEVICE

This invention relates to a device to recover refrigerant from a refrigeration circuit and to recharge the refrigeration circuit with the recovered refrigerant.

Freon is a trademark for a series of fluorocarbon products, some of which we now know figure in the destruction of the earth's ozone layer. In response to this problem, the manufacture of Freon is being progressively restricted by legislation. Freon is the working fluid for many refrigeration circuits. In the past, in order allow the servicing of a refrigeration circuit, the refrigerant was first vented to the atmosphere. With the current understanding of the dangers of Freon, this is no longer an acceptable approach for refrigeration circuits containing Freon.

U.S. Pat. No. 4,364,236 to Lower issued Dec. 21, 1982 discloses a device for recovering refrigerant from a refrigeration circuit, purifying same, and then pumping the recovered refrigerant back into the refrigeration circuit thereby avoiding the venting of refrigerant to the atmosphere. More particularly, refrigerant from the refrigeration circuit is drawn by a compressor into an evaporator where it evaporates, the vapour then enters a compressor and is pumped by the compressor into a condenser which condenses the refrigerant to a liquid. The liquid refrigerant leaves the condenser and is temporarily stored in a reservoir. The recovered refrigerant next passes from the reservoir to a purifier whereat it is re-circulated for progressive purification. After the refrigeration circuit has been serviced, a vacuum pump is connected to the circuit to evacuate same of moisture laden air and refrigerant in the purifier is then pumped into the refrigeration circuit by a metering pump.

The Lower device, while avoiding the venting of refrigerant to atmosphere, is of reasonably complicated construction requiring, for example, three pumps: a compressor, a metering pump, and a vacuum pump. Furthermore, the separate condenser of Lower may retain a residue of refrigerant therein: residues are a known problem in condensers of a coiled construction. Any such residue will commingle with the refrigerant of the next refrigeration circuit to be connected to the device and will therefore find its way into this next refrigeration circuit. This is problematic when the device is employed with a refrigeration circuit utilising a different refrigerant from that of the residue as even small amounts of incompatible refrigerant may damage a refrigeration circuit.

The subject invention seeks to overcome drawbacks of known refrigerant recovery and recharging devices. According to this invention, there is provided a device for recovering refrigerant from a refrigeration circuit, comprising: inlet means for connection to a refrigeration circuit; an activatable compressor having a low pressure inlet and a high pressure outlet, said inlet of said compressor connected to said inlet means; a tank means for functioning as a refrigerant condenser and storage means having heat conducting walls and having an inlet through a bottom wall thereof, said tank constructed so that any liquid in said tank fills said tank from the bottom thereof, said tank means inlet connected to said outlet of said compressor; activatable means to cool the walls of said tank means; and a valve means connected between said compressor inlet and said inlet means; whereby said device may be coupled to a refrigeration circuit, said valve means opened and said compressor and cooling means activated whereupon refrigerant vapour is drawn from said refrigeration circuit and is pushed through said tank means inlet into said tank means, said refrigerant vapour condensing on contacting the walls of said tank means and the resultant liquid refrigerant collecting at the bottom of said tank means such that refrigerant vapour entering said tank means inlet bubbles through any collected liquid refrigerant and is thereby cooled.

In another aspect, the present invention comprises a method for condensing and storing refrigerant recovered from a refrigeration circuit comprising the steps of: (a) cooling the walls of a tank to provide condensing surfaces for said recovered refrigerant vapour and to cool any liquid refrigerant collected in said tank; and (b) porting recovered refrigerant vapour through the bottom of said tank so that said recovered refrigerant vapour bubbles through any liquid refrigerant collected in said tank and is thereby cooled.

The word "fluid", as used herein, means liquid or gas.

The sole FIGURE, which discloses an example embodiment of the invention, is a schematic view of a refrigerant recovery and recharging device made in accordance with this invention.

Turning to the FIGURE, the refrigerant recovery and recharging device of this invention is illustrated generally at 10. Access hoses 20 and 22 of inlets 12 and 14 of device 10 are shown tapped into a refrigeration circuit 16 at the high and low sides of the refrigerant circuit compressor 18. Inlets 12 and 14 include filters 24 and 26. The inlets are connected through inlet valves 30 and 32 of valve manifold 34 to a fluid circuit 28. Gauges 36 and 38 sense the pressure in inlets 12 and 14, respectively.

Segment **28*a* of the fluid circuit 28 connects the inlets 12 and 14 with the low pressure inlet 54 of a compressor 40. Segment 28*b* of the fluid circuit connects the high pressure outlet 56 of the compressor with inlet 58 in the bottom wall 60 of tank 42, and segment 28*c* of the fluid circuit connects the outlet 62 in the top wall 61 of tank 42 with the inlets 12 and 14. For reasons which will become apparent hereinafter, tank 42 functions as a condenser and as a storage means for condensed refrigerant. A valve 44 in the valve manifold is located in segment 28*a* of the fluid circuit and hence is positioned between the inlets (12 and 14) and the compressor 40. A further valve 46 in the valve manifold is located in segment 28*c* of the fluid circuit and hence is positioned between tank 42 and the inlets 12 and 14**.

Considering the device 10 in greater detail, compressor 40 may be of the reciprocating piston type. The compressor has an oil sump 74. The oil level in the sump may be viewed by way of oil sight glass 76.

Segment **28*b* of the fluid circuit leading from the high pressure outlet of the compressor incorporates an oil separator 66 which forms part of an oil separation loop 68. The oil separation loop includes a capillary tube 67 and a pressure switch 70 which controls a valve 72 in the loop in order to open the valve only when the pressure exceeds a pre-set pressure. Segment 28*b* also incorporates exit port 48. The exit port is selectively closed by manually operated valve 50. Segment 28*b* further incorporates one-way check valve 52 which allows fluid flow through the segment from the compressor 40 to the tank 42 but prevents flow in the opposite direction. A pressure switch 64 in segment 28*b* is connected to the power input of the compressor 40 by standard means (not shown) in order to shut down the compressor 40 if the pressure in segment 28***b* exceeds a pre-set maximum.

Tank 42 is constructed so that any liquid 63 in the tank collects at the bottom thereof; the tank includes a sight glass 78 by way of which the level of liquid 63 in the tank may be viewed. The tank is made of a heat conducting material, such as aluminium, and has a plurality of fins 80 along one side wall 81 of the tank. Fans 82 are positioned so as to blow air over fins 82 when activated. A tank outlet pipe 84 extends from proximate the bottom wall 60 of the tank to the tank outlet 62. A gauge 86 provides an indication of the pressure in the tank 42 and an automatic pressure relief valve 88 opens operated when gauge 86 indicates an overpressure condition. Spigot 90 provides access to vapour in tank 42 and spigot 92 provides access to the contents of segment 28*c* of the fluid circuit.

In the operation of the refrigerant recovery and recharging device of this invention, the high and low pressure sides of the compressor 18 of a dead (i.e., deactivated) refrigeration circuit 16 are connected to the device 10 through access hoses 20 and 22. The double connection is simply to increase the rate of refrigerant recovery. The compressor 40 of the subject device is then activated to create a partial vacuum in segment 28*a* of the fluid circuit between the fluid circuit valve 44 and the compressor inlet 54. Inlet vales 30 and 32 between access hoses 20 and 22, respectively, and the fluid circuit 28 may then be opened. As well the fluid circuit valve 44 may be opened whereupon refrigerant in the dead circuit boils off into segment 28*a* of the fluid circuit due to the pressure differential between the pressure in the dead circuit and the pressure in segment 28*a*. The initial pressure in the dead circuit depends on ambient temperature and the refrigerant used: this initial pressure may be over 100 psi. It is noted that segment 28*a* thus contains refrigerant vapour even though device 10 has no evaporator per se; the dead circuit itself acts as an evaporator.

In entering the fluid circuit 28, the refrigerant passes through filters 24 and 26 which remove particulate matter therefrom in order to protect the device 10 from wear due to such impurities.

As the compressor continues to operate, refrigerant vapour is pulled from segment 28*a* into the compressor 40 which outputs a high pressure hot refrigerant vapour (the heating of the vapour results from the heat of compression and heat absorbed from the compressor itself) to segment 28*b* and into the base of tank 42. The tank functions as a combined condenser and storage means, as follows. Fans 82 are activated to blow ambient air over fins 80 of the tank in order to cool the tank. Hot refrigerant vapour entering the initially empty tank condenses on contacting the cool walls of the tank and pools in the base 60 of the tank as liquid refrigerant 63. As the liquid level in the tank rises, vapour entering the base of the tank bubbles through this liquid 63 transferring heat thereto. In turn, the liquid conducts the absorbed heat to the walls of the tank. Consequently, vapour which has bubbled through the liquid 63 is precooled so that it either condenses in the liquid or more readily condenses on contacting the walls of the tank above the liquid. This process of heat transfer from the vapour to the liquid in the tank compensates for the reduced wall area available for vapour condensation as the liquid level rises such that it has been found the tank adequately condenses the vapour unit it is about 95% full. One-way check valve 52 prevents back flow of liquid refrigerant in segment 28*b*.

Oil separation loop 68 from the compressor outlet functions to return oil entrained in the refrigerant vapour to the compressor. That is, oil entrained in the vapour drops out in oil separator 66 at the compressor outlet and returns to the compressor sump 74 so as to maintain an operating supply of oil in the compressor. Capillary tube 67 in the loop 68 minimizes the pressure which is communicated from the high pressure side of the compressor to the low pressure side of the compressor. In consequence of the capillary tube, pressure controlled solenoid switch 70 is at the low pressure side of the compressor.

As the recovery of refrigerant from the dead circuit progresses, the pressure at the low pressure side of the compressor drops at the rate of refrigerant recover, and the pressure in the dead circuit, drops. When the pressure at the low pressure side of the compressor 40 drops to about 10 psi, pressure controlled solenoid switch 70 closes valve 72 in the oil separation loop. This cuts off the pressure communicated from the high pressure side of the compressor to its low pressure side through the capillary tube and hence increases the suction of the compressor. The device may be operated without the oil separation loop at this stage in the recovery process due to the fact the rate of recovery is sufficiently slow that the amount of oil entrained in the refrigerant vapour is minimal. Recovery then continues until essentially all refrigerant in the dead circuit has been evacuated. Completion of refrigerant recovery may be confirmed by gauges 36 and 38 which measure the pressure in the inlets 12 and 14, and hence in the dead circuit. Progression of recovery may also be monitored by way of tank sight glass 78.

After recovery, inlet valves 30 and 32 are closed and compressor 40 is deactivated whereupon repair work on the dead circuit may commence. While the repair work continues, the refrigerant liquid 63 sitting in tank 42 slowly cools and often reaches room temperature by the time the dead circuit is to be recharged. Room temperature refrigerant is at a low pressure so that the refrigerant, of itself, will not push into the dead circuit. Accordingly, to allow recharging, compressor 40 is restarted and fluid circuit valves 44 and 46 are opened in order to connect segment 28*c* with segment 28*a*. Compressor 40 lowers the pressure in segments 28*a* and 28*c* which draws liquid refrigerant 63 from tank 40 and vapourises same. The vapourised refrigerant is output from the compressor as a hot pressurised vapour which is condensed in tank 42 as aforedescribed. Accordingly, refrigerant is recirculated and the repeated vaporisation and condensation builds its temperature—and therefore its pressure. The oil separation loop is in operation during recirculation once the pressure builds to above about 10 psi. Once a suitable pressure has been reached as measured by gauge 86, fluid circuit valve 44 is closed and the compressor 40 stopped. Recharging will now occur when inlet valves 30 and/or 32 are opened since the now high pressure refrigerant in the tank 42 will push into the cool dead system. After recharging, tank 42 (and the portion of segment 28*b* above the one-way check valve 52) will normally be empty. Since device 10 does not have a separate condenser, the device is therefore free of residual liquid refrigerant once tank 42 has been emptied.

During repair, the dead circuit will generally be exposed to ambient air. Consequently, after the dead circuit has been repaired and resealed, it is necessary to remove this moisture laden air from the circuit. Accordingly, prior to recharging the dead circuit, exit valve 50 of exit port 48, inlet valves 30 and 32, and fluid circuit valve 44 may be opened and compressor 40 started so that the device 10 acts as a vacuum pump in order to pull the moisture laden ambient air from the dead circuit. One-way check valve 52 prevents back flow from the tank 42 during this operation.

Spigots 90 and 92 remain closed in normal operation. These spigots are only utilised when it is necessary to access refrigerant vapour in the top of tank 42 or refrigerant exiting the tank.

Most contaminants remain in the dead circuit when the refrigerant is boiled off. Filters in the recharged refrigeration circuit may be replaced several times over a short time period in order to remove such residual contaminants.

Due to the relatively simple construction of device 10 which requires only a single pump (compressor 40), the device is of relatively inexpensive construction, may be portable, and is reliable.

What is claimed is:

1. A device for recovering refrigerant from a refrigeration circuit, comprising:

inlet means for connection to a refrigeration circuit;

an activatable compressor having a low pressure inlet and a high pressure outlet, said inlet of said compressor connected to said inlet means;

a tank means, for functioning as a refrigerant condenser and storage means, having heat conducting walls and having an inlet through a bottom wall thereof, said tank means constructed so that any liquid in said tank means fills said tank from the bottom thereof, said tank means inlet connected to said outlet of said compressor;

activatable means to cool the walls of said tank means; and a valve means connected between said compressor inlet and said inlet means; whereby said device may be coupled to a refrigeration circuit, said valve means opened and said compressor and cooling means activated whereupon refrigerant vapour is drawn from said refrigeration circuit and is pushed through said tank means inlet into said tank means, said refrigerant vapour condensing on contacting the walls of said tank means and the resultant liquid refrigerant collecting at the bottom of said tank means such that refrigerant vapour entering said tank means inlet bubbles through any collected liquid refrigerant and is thereby cooled.

2. A device for recovering refrigerant from a refrigeration circuit and for recharging the refrigeration circuit with refrigerant, comprising:

inlet means for connection to a refrigeration circuit;

a fluid circuit connected to said inlet means;

a compressor having a low pressure inlet and a high pressure outlet connected in said fluid circuit;

a tank means for functioning as a refrigerant condenser and storage means, having heat conducting walls, said tank means connected in said fluid circuit between said high pressure outlet of said compressor and said inlet means, the inlet to said tank means being through a bottom wall of said tank means, said tank means constructed so that any liquid in said tank means fills said tank means from the bottom thereof;

means to cool the walls of said tank means;

a first valve means connected in said fluid circuit between said compressor and said inlet means;

a second valve means connected in said fluid circuit between said inlet means and said tank means;

whereby, in order to recover refrigerant from a refrigeration circuit, said device may be coupled to a refrigeration circuit, said first fluid circuit valve means opened and said compressor and said cooling means activated whereupon refrigerant vapour is drawn from said refrigeration circuit and pushed into said tank means by said compressor, said refrigerant vapour condensing on contacting the cooled walls of said tank means and the resultant liquid refrigerant collecting at the bottom of said tank means such that refrigerant vapour entering said tank means inlet bubbles through any collected liquid refrigerant and is thereby cooled, and whereby, in order to recharge a refrigeration circuit, said device may be coupled to a refrigeration circuit and said second valve means opened in order to communicate the outlet of said tank means to said refrigeration circuit.

3. The refrigerant recovery and recharging device of claim 2 wherein said compressor has a reservoir of operating oil and wherein operating oil for said compressor may entrain in fluid leaving said outlet of said compressor, said refrigerant recovery and recharging device further including an oil separator connected to the outlet of said compressor and a capillary tube connected between said oil separator and the oil reservoir of said compressor.

4. The refrigerant recovery and recharging device of claim 3 further including means to block the outlet of said capillary tube when the rate of discharge of fluid from said compressor falls sufficiently such that minimal oil is entrained in such discharged fluid.

5. The refrigerant recovery and recharging device of claim 2 further including an inlet valve in said inlet means whereby, prior to recharging a refrigeration circuit, said inlet valve means is closed and said first and second fluid circuit valves are opened and said compressor and cooling means activated in order to recirculate refrigerant in said tank means while evaporating and condensing same thereby raising the pressure of the refrigerant in said tank means.

6. The refrigerant recovery and recharging device of claim 5 including a one-way check valve connected in said fluid circuit between said compressor and said tank means for preventing fluid flow from said tank means to said compressor.

7. The refrigerant recovery and recharging device of claim 6 including an exit port from said fluid circuit between said compressor and said one-way check valve, said exit comprising a valve, whereby when said inlet means is connected to a refrigeration circuit, said compressor may be activated and said inlet valve means, said first fluid circuit valve means, and said exit valve may be opened whereupon fluid is drawn from said refrigeration circuit and pushed through said exit port.

8. The refrigerant recovery and recharging device of claim 7 wherein said means to cool said tank means comprise fins on said tank means and fan means for blowing ambient air over said fins.

9. The refrigerant recovery and recharging device of claim 8 including an outlet pipe extending from proximate the bottom of said tank means to said tank means outlet.

10. The refrigerant recovery and recharging device of claim 9 wherein said inlet means comprise refrigerant filter means.

* * * * *